United States Patent [19]

Taylor et al.

[11] 4,026,556

[45] May 31, 1977

[54] GAME APPARATUS EMPLOYING BALLS AND FRAME

[75] Inventors: Jacob H. Taylor; Madge G. Taylor, both of Washington, W. Va.

[73] Assignee: The Raymond Lee Organization, Inc., a part interest

[22] Filed: Feb. 9, 1976

[21] Appl. No.: 656,179

[52] U.S. Cl. ..... 273/123 R; 273/118 R; 273/127 B

[51] Int. Cl.[2] ..... A63D 3/00

[58] Field of Search ..... 273/118–129, 273/177 R, 181 R, 181 A, 56

[56] References Cited

UNITED STATES PATENTS

| | | | |
|---|---|---|---|
| 657,233 | 9/1900 | Allen | 273/127 D |
| 1,561,934 | 11/1925 | Kennedy | 273/127 B |
| 1,637,517 | 8/1927 | Bristow | 273/127 D |
| 1,712,561 | 5/1929 | Jaspert | 273/127 D X |
| 2,238,703 | 4/1941 | McIver et al. | 273/126 R |
| 2,427,434 | 9/1947 | Whitehouse | 273/127 D |
| 2,583,493 | 1/1952 | Prentice et al. | 273/127 B X |
| 2,662,518 | 12/1953 | Luthi | 273/127 B X |

*Primary Examiner*—Richard J. Apley

[57] ABSTRACT

An elongated member has a plurality of like partitions extending downwardly from it. These partitions are paced at regular intervals, and form channels through which any one of the plurality of like balls can be rolled. A fence retains any balls that are rolled through the channels. A shelf for storing the balls is included.

1 Claim, 3 Drawing Figures

GAME APPARATUS EMPLOYING BALLS AND FRAME

SUMMARY OF THE INVENTION

The apparatus described here is designed to provide a game which can entertain aged people and the handicapped, although it can be played enjoyable by anyone. A flat playing surface, such as a grass field or a flat floor is employed.

In this invention, a horizontally elongated member has a plurality of like, parallel vertical partitions extending downwardly from it. These partitions form a plurality of like vertical channels, through any one of which one of a collection of like balls can be rolled. A fence retains any balls rolled through the channels, and a shelf secured to the member is provided to store any balls not in use.

DETAILED DESCRIPTION OF PREFERRED EMBODIMENTS

Figure 1:
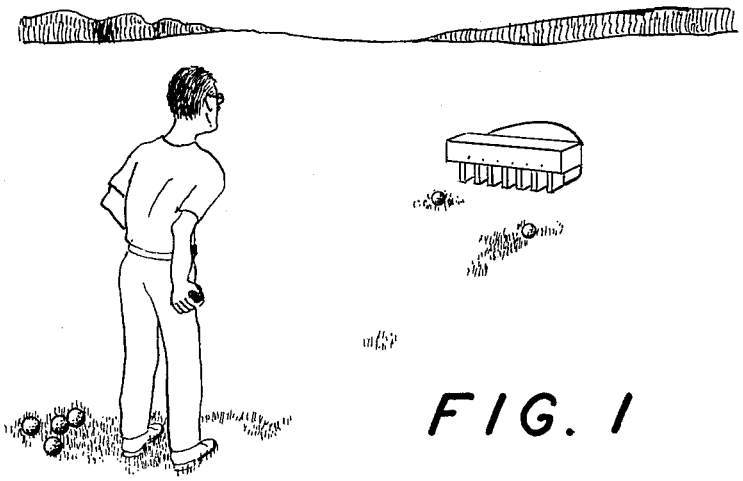
FIG. 1 shows the invention in use.
Figure 2:
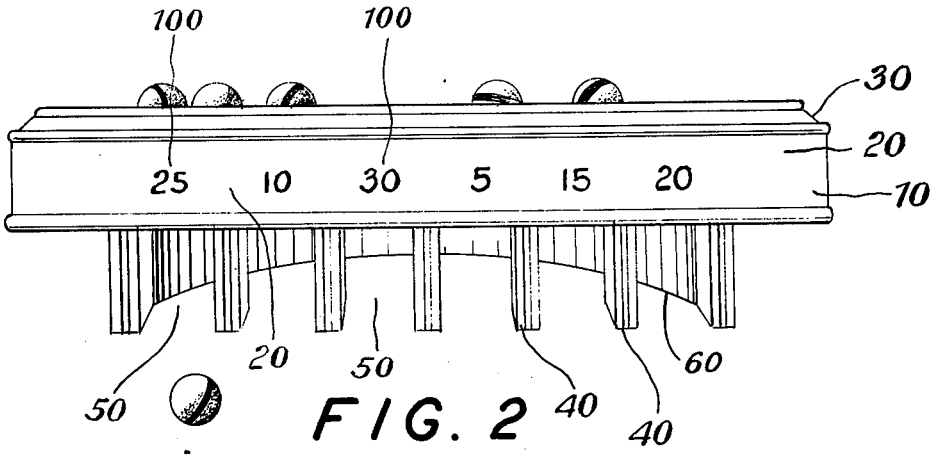
FIG. 2 is a front view of the invention.
Figure 3:
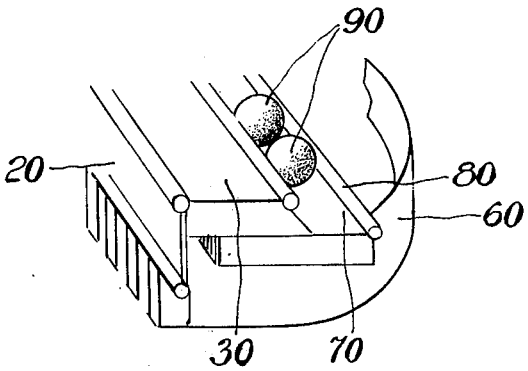
FIG. 3 is a side view of the invention.

A horizontally elongated member 10 has a flat front piece 20 and a flat top piece 30 at right angles to it. Extending downwardly from the member are a plurality of like, parallel, regularly spaced vertical partitions 40 that are attached to the front and top piece and that form a plurality of like vertical channels 50.

Extending between the end of the member is a semi-circular horizontally elongated fence 60 that forms a vertical curved wall behind the rears of the channels.

Behind and below piece 30 is shelf 70 that rests upon the end of the fence. At the rear end of the shelf is a piece of doweling 80. (Doweling is also used along the elongated edges of pieces 20 and 30.) It can be seen that balls 90 can be stored on the shelf when not needed.

The balls used in this invention are all of like diameter, and all can pass through any of the channels. When the device is placed on a playing surface, any balls actually rolled between the partitions will be retained by the fence. Numbers 100 are painted on piece 20 above the channels. These numbers represent the scores to be made by each player upon rolling a ball through the corresponding channel.

We claim:

1. Game apparatus comprising:

a plurality of balls of like diameter;

a horizontally elongated member;

a plurality of parallel partitions extending vertically downwardly from the member and resting upon a playing surface to keep the member in a horizontal position, the partitions being spaced from each other at regular distances which are greater than the diameter of any ball, so as to form a plurality of vertical channels through which the balls may be rolled;

a semi-circular fence attached to the ends of the member and forming a pen behind the partitions to enclose balls rolled between the partitions between the rear ends of the partitions and the fence; and a horizontal shelf for storing the balls, the shelf being located behind the member and resting on the fence.

* * * * *